US009878326B2

(12) United States Patent
Squier et al.

(10) Patent No.: US 9,878,326 B2
(45) Date of Patent: Jan. 30, 2018

(54) FIBER-FOCUSED DIODE-BAR OPTICAL TRAPPING FOR MICROFLUIDIC MANIPULATION

(75) Inventors: Jeff Squier, Golden, CO (US); David W. M. Marr, Golden, CO (US); Robert Applegate, Golden, CO (US); Tor Vestad, Golden, CO (US)

(73) Assignee: Colorado School of Mines, Golden, CO (US)

( * ) Notice: Subject to any disclaimer, the term of this patent is extended or adjusted under 35 U.S.C. 154(b) by 1579 days.

(21) Appl. No.: 12/239,449

(22) Filed: Sep. 26, 2008

(65) Prior Publication Data

US 2009/0110010 A1 Apr. 30, 2009

Related U.S. Application Data

(60) Provisional application No. 60/975,429, filed on Sep. 26, 2007.

(51) Int. Cl.
*B01L 3/00* (2006.01)

(52) U.S. Cl.
CPC . *B01L 3/502715* (2013.01); *B01L 2200/0668* (2013.01); *B01L 2200/10* (2013.01); *B01L 2400/0454* (2013.01)

(58) Field of Classification Search
CPC ..... B01L 3/502715; B01L 2200/10; B01L 2200/0668
See application file for complete search history.

(56) References Cited

U.S. PATENT DOCUMENTS 4,190,535 A 2/1980 Luderer
5,002,647 A 3/1991 Tanabe et al.
5,021,224 A 6/1991 Nakajima
5,098,850 A 3/1992 Nishida et al.
5,148,511 A * 9/1992 Savu et al. ..... 385/145
5,176,786 A 1/1993 Debe
5,187,089 A 2/1993 Scott et al.
5,304,487 A 4/1994 Wilding et al.
(Continued)

FOREIGN PATENT DOCUMENTS

DE 19712309 5/1998
EP 1221342 7/2002
(Continued)

OTHER PUBLICATIONS

Šery et al. "Compact laser tweezers", 15th Czech-Polish-Slovak Conference on Wave and Quantum Aspects of Contemporary Optics, Proc. of SPIE, 2007, Proc. of SPIE vol. 6609 66090N, pp. 1-7.*
(Continued)

*Primary Examiner* — Yelena G Gakh
(74) *Attorney, Agent, or Firm* — Sheridan Ross P.C.

(57) ABSTRACT

The direct integration of light and optical control into microfluidic systems presents a significant hurdle to the development of portable optical trapping-based devices. A simple, inexpensive fiber-based approach is provided that allows for easy implementation of diode-bars for optical particle separations within flowing microfluidic systems. Models have also been developed that demonstrate the advantages of manipulating particles within flow using linear geometries as opposed to individually focused point traps as traditionally employed in optical-trapping micro-manipulation.

10 Claims, 4 Drawing Sheets

(56) References Cited

U.S. PATENT DOCUMENTS

| | | | |
|---|---|---|---|
| 5,427,663 | A | 6/1995 | Austin |
| 5,512,745 | A | 4/1996 | Finer et al. |
| 5,541,072 | A | 7/1996 | Wang et al. |
| 5,622,831 | A | 4/1997 | Liberti et al. |
| 5,639,669 | A | 6/1997 | Ledley |
| 5,707,799 | A | 1/1998 | Hansmann et al. |
| 5,715,946 | A | 2/1998 | Reichenbach |
| 5,750,339 | A | 5/1998 | Smith |
| 5,753,038 | A | 5/1998 | Vichr et al. |
| 5,770,029 | A | 6/1998 | Nelson et al. |
| 5,837,115 | A | 11/1998 | Austin |
| 5,855,753 | A | 1/1999 | Trau et al. |
| 5,858,188 | A | 1/1999 | Soane et al. |
| 5,866,345 | A | 2/1999 | Wilding et al. |
| 5,928,880 | A | 7/1999 | Wilding et al. |
| 5,952,173 | A | 9/1999 | Hansmann et al. |
| 6,007,690 | A | 12/1999 | Nelson |
| 6,017,390 | A | 1/2000 | Charych et al. |
| 6,054,034 | A | 4/2000 | Soane et al. |
| 6,055,106 | A | 4/2000 | Grier et al. |
| 6,067,859 | A | 5/2000 | Kas et al. |
| 6,074,827 | A | 6/2000 | Nelson |
| 6,128,006 | A | 10/2000 | Rosenberg et al. |
| 6,156,270 | A | 12/2000 | Buechler |
| 6,187,089 | B1 | 2/2001 | Phillips et al. |
| 6,197,523 | B1 | 3/2001 | Rimm et al. |
| 6,221,671 | B1 | 4/2001 | Groner et al. |
| 6,241,894 | B1 | 6/2001 | Briggs et al. |
| 6,251,691 | B1 | 6/2001 | Seul |
| 6,256,093 | B1 | 7/2001 | Ravid et al. |
| 6,256,096 | B1 | 7/2001 | Johnson |
| 6,265,229 | B1 | 7/2001 | Fodstad et al. |
| 6,315,940 | B1 | 11/2001 | Nisch et al. |
| 6,344,326 | B1 | 2/2002 | Nelson |
| 6,361,958 | B1 | 3/2002 | Shieh |
| 6,368,871 | B1 | 4/2002 | Christel et al. |
| 6,387,290 | B1 | 5/2002 | Brody et al. |
| 6,406,903 | B2 | 6/2002 | Bray et al. |
| 6,432,630 | B1 | 8/2002 | Blankenstein |
| 6,454,938 | B2 | 9/2002 | Moon et al. |
| 6,465,225 | B1 | 10/2002 | Fuhr et al. |
| 6,468,346 | B2 | 10/2002 | Arnowitz et al. |
| 6,533,903 | B2 | 3/2003 | Hayward et al. |
| 6,540,895 | B1 | 4/2003 | Spence et al. |
| 6,565,225 | B2 | 5/2003 | Mabuchi et al. |
| 6,613,525 | B2 | 9/2003 | Nelson et al. |
| 6,632,619 | B1 | 10/2003 | Harrison et al. |
| 6,635,163 | B1 | 10/2003 | Han et al. |
| 6,664,104 | B2 | 12/2003 | Pourahmadi et al. |
| 6,685,841 | B2 | 2/2004 | Lopez et al. |
| 6,744,038 | B2 | 6/2004 | Wang et al. |
| 6,746,503 | B1 | 6/2004 | Benett et al. |
| 6,762,059 | B2 | 7/2004 | Chan et al. |
| 6,783,647 | B2 | 8/2004 | Culbertson et al. |
| 6,784,420 | B2 | 8/2004 | Wang et al. |
| 6,797,057 | B1 | 9/2004 | Amos et al. |
| 6,802,489 | B2 | 10/2004 | Marr et al. |
| 6,815,664 | B2 | 11/2004 | Wang et al. |
| 6,830,936 | B2 | 12/2004 | Anderson et al. |
| 6,833,542 | B2 | 12/2004 | Wang et al. |
| 6,878,271 | B2 | 4/2005 | Gilbert et al. |
| 6,881,315 | B2 | 4/2005 | Lida et al. |
| 6,893,502 | B2 | 5/2005 | Papadimitrakopoulos et al. |
| 6,893,881 | B1 | 5/2005 | Fodstad et al. |
| 6,913,697 | B2 | 7/2005 | Lopez et al. |
| 6,958,245 | B2 | 10/2005 | Seul et al. |
| 7,068,874 | B2 | 6/2006 | Wang et al. |
| 7,088,455 | B1 | 8/2006 | Kirkpatrick et al. |
| 7,150,812 | B2 | 12/2006 | Huang et al. |
| 7,155,082 | B2 | 12/2006 | Oakey et al. |
| 7,202,045 | B2 | 4/2007 | Hanash et al. |
| 7,205,157 | B2 | 4/2007 | Jurgensen et al. |
| 7,214,348 | B2 | 5/2007 | Desmond et al. |
| 7,241,988 | B2 | 7/2007 | Gruber et al. |
| 7,276,170 | B2 | 10/2007 | Oakey et al. |
| 7,312,085 | B2 | 12/2007 | Chou et al. |
| 7,318,902 | B2 | 1/2008 | Oakey et al. |
| 7,435,568 | B2 | 10/2008 | Kas et al. |
| 7,442,339 | B2 | 10/2008 | Sundararajan et al. |
| 7,460,240 | B2 | 12/2008 | Akcakir |
| 7,472,794 | B2 | 1/2009 | Oakey et al. |
| 7,745,788 | B2 | 6/2010 | Appleyard et al. |
| 2001/0036672 | A1 | 11/2001 | Anderson et al. |
| 2002/0005354 | A1 | 1/2002 | Spence et al. |
| 2002/0058332 | A1 | 5/2002 | Quake et al. |
| 2002/0062783 | A1 | 5/2002 | Bray |
| 2002/0108859 | A1 | 8/2002 | Wang et al. |
| 2002/0113204 | A1 | 8/2002 | Wang et al. |
| 2002/0115163 | A1 | 8/2002 | Wang et al. |
| 2002/0115164 | A1* | 8/2002 | Wang et al. ..... 435/173.9 |
| 2002/0123078 | A1 | 9/2002 | Seul et al. |
| 2002/0123112 | A1 | 9/2002 | Wang et al. |
| 2002/0132315 | A1 | 9/2002 | Wang et al. |
| 2002/0132316 | A1 | 9/2002 | Wang et al. |
| 2002/0172987 | A1 | 11/2002 | Terstappen et al. |
| 2003/0024470 | A1 | 2/2003 | Myerson |
| 2003/0032204 | A1* | 2/2003 | Walt et al. ..... 436/518 |
| 2003/0072682 | A1 | 4/2003 | Kikinis |
| 2003/0124516 | A1 | 7/2003 | Chung et al. |
| 2004/0067167 | A1 | 4/2004 | Zhang et al. |
| 2004/0121343 | A1 | 6/2004 | Buechler et al. |
| 2005/0049793 | A1 | 3/2005 | Paterlini-Brechot |
| 2005/0175478 | A1 | 8/2005 | Marr et al. |
| 2006/0060767 | A1 | 3/2006 | Wang et al. |
| 2006/0171846 | A1 | 8/2006 | Marr |
| 2007/0026533 | A1 | 2/2007 | Sundararajan et al. |
| 2007/0125941 | A1 | 6/2007 | Lee et al. |
| 2008/0093306 | A1 | 4/2008 | Oakey et al. |
| 2009/0026387 | A1 | 1/2009 | Squier |
| 2009/0062828 | A1 | 3/2009 | Marr |
| 2009/0188795 | A1 | 7/2009 | Oakey et al. |
| 2009/0280518 | A1 | 11/2009 | Adamo et al. |
| 2011/0270434 | A1 | 11/2011 | Fischer et al. |
| 2013/0183660 | A1 | 7/2013 | Yu et al. |
| 2013/0230879 | A1 | 9/2013 | Neeves et al. |
| 2016/0263391 | A1 | 9/2016 | Tasci et al. |

FOREIGN PATENT DOCUMENTS

| | | |
|---|---|---|
| EP | 1412729 | 1/2003 |
| EP | 1438398 | 5/2003 |
| EP | 1338894 | 8/2003 |
| EP | 1485713 | 9/2003 |
| EP | 1499706 | 10/2003 |
| EP | 1539350 | 1/2004 |
| EP | 1529211 | 2/2004 |
| EP | 1542802 | 3/2004 |
| EP | 1418003 | 5/2004 |
| EP | 1462800 | 9/2004 |
| EP | 919812 | 10/2004 |
| WO | WO 94/29707 | 12/1994 |
| WO | WO 98/10267 | 3/1998 |
| WO | WO 99/44064 | 9/1999 |
| WO | WO 00/00816 | 1/2000 |
| WO | WO 02/12896 | 2/2002 |
| WO | WO 02/28523 | 4/2002 |
| WO | WO 02/30562 | 4/2002 |
| WO | WO 02/44689 | 6/2002 |
| WO | WO 03/031938 | 4/2003 |
| WO | WO 03/066191 | 8/2003 |
| WO | WO 2004/029221 | 4/2004 |
| WO | WO 2004/037374 | 5/2004 |
| WO | WO 2004/056978 | 7/2004 |

OTHER PUBLICATIONS

Refdoc.fr. http://cat.inist.fr/?aModele=afficheN&cpsidt=19152855, 2007.*

"Fiber Coupled LED Source and Accessories", http://www.wt-technology.com/LED.htm, no date is available.*

Applegate et al., "Microfluidic sorting system based on optical waveguide integration and diode laser bar trapping", Lab on a Chip, Jan. 20, 2006, vol. 6, pp. 422-426, The Royal Society of Chemistry.

(56) References Cited

OTHER PUBLICATIONS

Applegate et al., "Optical trapping, manipulation, and sorting of cells and colloids in microfluidic systems with diode laser bars", Colorado School of Mines, 2002, pp. 1-9.
Archer et al. "Cell Reactions to Dielectrophoretic Manipulation." Biochemical and Biophysical Research Communications. 1999;257:687-98.
Ashcroft et al., "Solid State Physics." Orlando, FL: Saunders College Publishing; 1976.
Author Unknown, "MicCell: Frequently Asked Questions", available at www.gesim.de, 2007, 4 pages.
Author Unknown, "The Optical Stretcher", available at http://www.uni/leipzig.de/~pwm/kas/os/os.html, cite updated on Nov. 23, 2005, 2 pages.
Bauer, "Advances in cell separation: recent developments in counterflow centrifugal elutriation and continuous flow cell separation." Journal of Chromatography. 1999;722:55-69.
Becker et al. "Fabrication of Microstructures With High Aspect Ratios and Great Structural heights by Synchrotron Radiation Lithography, Galvanoforming, and Plastic Moulding (LIGA Process)." Microelectronic Engineering. 1986;4:35-56.
Becker et al. "Planar quartz chips with submicron channels for two-dimensional capillary electrophoresis applications." J. Micromech Microeng. 1998;9:24-28.
Beebe et al., "Functional Hydrogel Structures for Autonomous Flow Control Inside Microfluidic Channels", Nature, Apr. 6, 2000, pp. 588-590, 404, Nature Publishing Group (USA), a division of Macmillan Publishers Ltd., United Kingdom.
Benincasa et al. "Cell Sorting by One Gravity SPLITT Fractionation." Analytical Chemistry. 2005; 77(16):5294-5301.
Berg, "Random Walks in Biology." Princeton University Press. Princeton, NJ; 1993.
Brown et al. "Optical Waveguides Via Viscosity-Mismatched Microfluidic Flows." Department of Chemical Engineering, Colorado School of Mines. Applied Physics Letters 88, 134109 (2006).
Chan, et al., "DNA Mapping Using Microfluidic Stretching and Single-Molecule Detection of Flourescent Site-Specific Tags", Genome Research, 2004, vol. 14, pp. 1137-1146, Cold Spring Harbor Laboratory Press.
Chiu et al., "Patterned Deposition of Cells and Proteins Onto Surfaces by Using Three-Dimensional Microfluidic Systems", Proceedings of the National Academy of Sciences of the United States of America, Mar. 14, 2000, pp. 2408-2413, 97-#6, National Academy of Sciences, USA.
Chou et al., "A Microfabricated Device for Sizing and Sorting DNA Molecules", Proceedings of the National Academy of Sciences of the United States of America, Jan. 5, 1999, pp. 11-13, 96-#1, National Academy of Sciences, USA.
Chou et al., "Sorting by diffusion: An asymmetric obstacle course for continuous molecular separation." PNAS. 1999; 96(24):13762-13765.
De Kretser et al., "The Separation of Cell Populations using Monoclonal Antibodies attached to Sepharose." Tissue Antigens. 1980;16:317-325.
Delamarche et al., "Microfluidic Networks for Chemical Patterning of Substrates: Design and Application to Bioassays", Journal of the American Chemical Society, Jan. 9, 1998, pp. 500-508, 120, American Chemical Society, USA.
Delamarche et al., "Patterned Delivery of Immunoglobulins to Surfaces Using Microfluidic Networks", Science, May 2, 1997, pp. 779-781, 276, American Association for the Advancement of Science, USA.
Deshmukh et al., "Continuous Micromixer With Pulsatile Micropumps. Solid-State Sensor and Actuator Workshop." Hilton Head Island, South Carolina; Jun. 4-8, 2000:73-76.
Desprat, et al., "Creep Function of a Single Living Cell", Biophysical Journal, Mar. 2005, vol. 88, pp. 2224-2233, Biophysical Society.
Duffy et al., "Rapid Prototyping of Microfluidic Systems in Poly(dimethylsiloxane)", Anal. Chem., 70 (23) 4974-4984, 1998 (abstract only).
Eigen et al., "Sorting Single Molecules: Application to Diagnostics and Evolutionary Biotechnology", Proceedings of the National Academy of Sciences of the United States of America, Jun. 1994, pp. 5740-5747, 91, National Academy of Sciences, USA.
Evans et al., "The Bubble Spring and Channel (BSAC) Valve: An Actuated, Bi-Stable Mechanical Valve for In-Plane Fluid Control. Transducers '99." Sendai, Japan; Jun. 7-10, 1999.
Eyal et al., "Velocity-independent microfluidic flow cytometry", Electrophoresis, Aug. 2002;23(16):2653-7 (abstract only).
Farooqui et al. "Microfabrication of Submicron Nozzles in Silicon Nitride." Journal of Microelectromechanical Systems. 1992; 1(2):86-88.
Fiedler et al., "Dielectrophoretic Sorting of Particles and Cells in a Microsystem", Analytical Chemistry, May 1, 1998, pp. 1909-1915, 70-#9, American Chemical Society, USA.
Freemantle, "Downsizing Chemistry", Chemical & Engineering News, Feb. 22, 1999, pp. 27-39, 77-#8, American Chemical Society.
Fu et al., "A Microfabricated Flourescence-Activated Cell Sorter", Nature Biotechnology, Nov. 1999, pp. 1109-1111, 17, Nature America Inc., USA.
Fu et al., "An integrated miscrofabricated cell sorter." Analytical Chemistry. 2002;74(11):2451-2457.
Fuhr et al., "Biological Application of Microstructures", Topics in Current Chemistry, 1997, pp. 83-116, 194, Springer-Verlag, Germany.
Gambin et al. "Microfabricated Rubber Microscope Using Soft Solid Immersion Lenses." Department of Applied Physics, California Institute of Technology. Applied Physics Letters 88, 174102 (2006).
Gast, et al., "The development of integrated microfluidic systems at GeSiM", Lab on a Chip, 2003, vol. 3, pp. 6N-1 ON, The Royal Society of Chemistry.
Gast, et al., "The microscopy cell (MicCell), a versatile modular flowthrough system for cell biology, biomaterial research, and nanotechnology", Microfluid Nanofluid (2006), published on-line Jul. 27, 2005, vol. 2, pp. 21-36, Springer-Verlag.
Giddings, "Chemistry 'Eddy' Diffusion in Chromatography." Nature. 1959;184:357-358.
Giddings, "Field-Flow Fractionation: Analysis of Macromolecular, Colloidal, and Particulate Materials." Science. 1993;260:1456-1465.
Giddings, "Unified Separation Science." John Wiley & Sons, Inc. 1991; Cover Page & Table of Contents only.
Gu, et al., "A single beam near-field laser trap for optical stretching, folding and rotation of erythrocytes", Optics Express, Feb. 5, 2007, vol. 15, No. 3., pp. 1369-1375, Optical Society of America.
Guck, et al., "Optical Deformability as an Inherent Cell Marker for Testing Malignant Transformation and Metastatic Competence", Biophysical Journal, May 2005, vol. 88, pp. 3689-3698, Biophysical Society.
Han et al., "Separation of Long DNA Molecules in a Microfabricated Entropic Trap Array." Science. 2000;288: 1026-1029.
Huang et al., "A DNA prism for high-speed continuous fractionation of large DNA molecules." Nature Biotechnology. 2002;20:1048-1051.
Huang et al., "Role of Molecular Size in Ratchet Fractionation." 2002; 89(17):178301-1-178301-4.
Huang et al., "Electric Manipulation of Bioparticles and Macromoledules on Microfabricated Electrodes", Analytical Chemistry, Apr. 1, 2001, pp. 1549-1559, 73-#7, American Chemical Society, USA.
Huh et al., "Gravity-driven microhydrodynamics-based cell sorter (microHYCS) for rapid, inexpensive, and efficient cell separation and size-profiling." 2nd Annual International IEEE-EMBS Special Topic Conference on Microtechnology in Medicine and Biology. Madison, Wisconsin USA; May 2-4, 2002:466-469.
Jeon et al., "Generation of Solution and Surface Gradients using Microfluidic Systems", Langmuir, 2000, pp. 8311-8316, 16-#22, American Chemical Society, USA.
Kamholz et al., "Quantitative Analysis of Molecular Interaction in a Microfluidic Channel: the T-Sensor", Analytical Chemistry, Dec. 1, 1999, pp. 5340-5347, 71-#23, American Chemical Society, USA.

(56) References Cited

OTHER PUBLICATIONS

Kenis et al., "Microfabrication Inside Capillaries Using Multiphase Laminar Flow Patterning", Science, Jul. 2, 1999, pp. 83-85, 285, American Association for the Advancement of Science, USA.
Kim et al. Polymer microstructures formed by moulding in capillaries. Nature. 1995;376:581-584.
Kim, et al., "Stretching and immobilization of DNA for studies of protein—DNA interactions at the single-molecule level", Nano Review, Apr. 18, 2007, Nanoscale Res Letter vol. 2, pp. 185-201, Springer.
Kumar et al. Cell Separation: A Review. Pathology. 1984;16:53-62.
Lang, et al., "Resource Letter: LBOT-1: Letter based optical tweezers", Am J Phys., Mar. 2003, vol. 71(3), pp. 201-215, National Institute of Health.
Li et al, "Transport, Manipulation, and Reaction of Biological Cells On-Chip Using Electrokinetic Effects", Analytical Chemistry, Apr. 15, 1997, pp. 1564-1568, 69-#8, American Chemical Society, USA.
Lim, et al., "Large deformation of living cells using laser traps", Acta Materialia, Apr. 19, 2004, vol. 52, Issue 7, pp. 1837-1845, Elsevier Science Ltd., (Only abstract and figures/tables provided, 6 pages).
Lincoln et al., "High-Throughput Rheological Measurements with an Optical Stretcher", Methods in Cell Biology, vol. 83, 2007, pp. 397-423 (abstract only).
Lincoln, et al., "Deformability-Based Flow Cytometry", Wiley InterScience, May 17, 2004, Cytometry Part A 59A, pp. 203-209, Wiley-Liss, Inc.
Lu, et al., "Viscoelastic properties of individual glial cells and neurons in the CNS", PNAS, Nov. 21, 2006, vol. 103, No. 47, pp. 17759-17764, The National Academy of Sciences of the USA.
Martin et al., "Feeling with light for cancer", 2006, Progress in biomedical optics and imaging, vol. 7 (abstract only).
McClain et al., "Flow Cytometry of *Escherichia coli* on Microfluidic Devices", Anal. Chem., 73(21), 5334-5338, 2001 (abstract only).
Mehrishi et al. "Electrophoresis of cells and the biological relevance of surface charge." Electrophoresis. 2002;23:1984-1994.
MicCell™ Parts List, GeSiM, www.gesim.de, 2007, 2 pages.
MicCell™ Special Designs (Selection), GeSiM, www.gesim.de, date unknown, 2 pages.
Moore et al. Lymphocyte fractionation using immunomagnetic colloid and a dipole magnet flow cell sorter. J Biochem Biophys Methods. 1998;37:11-33.
Oakey et al., "Laminar Flow-Based Separations at the Microscale", Biotechnology Progress, Sep. 24, 2002, pp. 1439-1442, 18-#6, American Chemical Society and the American Institute of Chemical Engineers, USA.
Olson et al., "An In Situ Flow Cytometer for the Optical Analysis of Individual Particles in Seawater", found at http://www.whoi.edu/science/B/Olsonlab/insitu2001.htm, publication date unknown.
Pamme et al., "Counting and sizing of particles and particle agglomerates in a microfluidic device using laser light scattering: application to a particle-enhanced immunoassay", Lap Chip, 2003, 3, 187-192.
Product literature for GEM, a systme for blood testing: "GEM PCL Step by Step Guide" and "GEM Premier 3000", publication date unknown.
Raymond et al. "Continuous Separation of High Molecular Weight Compounds using a Microliter Volume Free-Flow Electrophoresis Microstructure." 1996;68:2515-2522.
Singh, et al., "A Miniaturized Wide-Angle 2D Cytometer", Wiley InterScience, Feb. 23, 2006, Cytometry Part A 69A, pp. 307-315, International Society for Analytical Cytology.
Takayama et al. "Patterning Cells and Their Environments Using Multiple Laminar Fluid Flows in Capillary Netwoorks", Proceedings of the National Academy of Sciences of the United States of America, May 11, 1999, pp. 5545-5548, 96-#10, national Academy of Sciences, USA.
Takayama et al. "Subcellular Position of Small Molecules", Nature, Jun. 28, 2001, p. 1016, 411, Nature Publishing Group (USA), a division of Macmillan Publishers Ltd., United Kingdom.
Terray et al., "Microfluidic Control Using Colloidal Devices", Science vol. 296, Jun. 7, 2002, pp. 1841-1844.
Tong et al. Low Temperature Wafer Direct Bonding. Journal of Microelectromechanical Systems. 1994;3:29-35.
Turner et al. Confinement-Induced Entropic Recoil of Single DNA Molecules in a Nanofluidic Structure. Physical Review Letters. 2002;88:128103.1-128103.4.
Vezenov et al. "Integrated Fluorescent Light Source for Optofluidic Applications." Department of Chemistry and Chemical Biology, Harvard University. Applied Physics Letters 86, 041104 (2005).
Visscher, et al., "Single Beam Optical Trapping Integrated in a Confocal Microscope for Biological Applications", Cytometry , Apr. 10, 1991, vol. 12, pp. 485-491, Wiley-Liss, Inc.
Voldman et al. Holding Forces of Single-Particle Dielectrophoretic Traps. Biophysical Journal.2001;80:531-541.
Volkmuth et al. DNA electrophoresis in microlithographic arrays. Letters to Nature (1992) vol. 358; p. 600.
Weigl et al., "Microfluidic Diffusion-Based Separation and Detection", Science, Jan. 15, 1999, pp. 346-347, 283-#5400, American Association for the Advancement of Science, USA.
Wolfe et al. "Dynamic Control of Liquid-Core/Liquid-Cladding Optical Waveguides." Department of Chemistry and Chemical Biology. Harvard University. Aug. 24, 2004, vol. 101, No. 34. pp. 12434-12438.
Wuite, et al., "An Integrated Laser Trap/Flow Control Video Microscope for the Study of Single Biomolecules", Biophysical Journal, Aug. 2000, vol. 29, pp. 1155-1167, Biophysical Society.
Xu et al. Dielectrophoresis of human red cells in microchips. Electrophoresis. 1999;20:1829-1831.
Zhang et al. High-speed free-flow electrophoresis on chip. Anal Chem. 2003;75:5759-5766.
U.S. Appl. No. 14/307,269, filed Jun. 17, 2014, Sawetski et al.
Ashkin et al. "Optical Trapping and Manipulation of Viruses and Bacteria," 1987, Science, vol. 235, pp. 1517-1520.
Baldessari et al., "Two touching spherical drops in uniaxial extensional flow: Analytic solution to the creeping flow problem," 2005, Journal of Colloid and Interface Science, vol. 289, pp. 262-270.
Lumsdon et al. "Two-Dimensional Crystallization of Microspheres by a Coplanar AC Electric Field," 2004, Langmuir, vol. 20, pp. 2108-2116.
Sawetzki et al., "Viscoelasticity as a Biomarker for High-Throughput Flow Cytometry," 2013, Biophyiscal Journal, vol. 105(10), pp. 2281-2288.
Sraj et al. "Cell deformation cytometry using diode-bar optical stretchers," Journal of Biomedical Optics, Jul./Aug. 2010, vol. 15, No. 4, 7 pages.
Babincova et al., "Selective treatment of neoplastic cells using ferritin-mediated electromagnetic hyperthermia," Medical Hypotheses, 2000, vol. 54(2), pp. 177-179.
Davies et al. "Optically Controlled Collisions of Biological Objects." SPIE Proceedings, Optical Investigations of Cells In Vitro and In Vivo, 15, Apr. 29, 1998, pp. 15-22.
Ghosh et al., "Controlled Propulsion of Artificial Magnetic Nanostructured Propellers," Nano Letters, 2009, vol. 9(6), pp. 2243-2245.
Hartford, "Google's Next Frontier: Inside the Human Body," Nanotechnology, 2014, retrieved from http://www.mddionline.com/article/google%E2%80%99s-next-frontier-inside-human-body-10-28-2014.
Lanza et al., "Magnetic resonance molecular imaging with nanoparticles," Joural of Nuclear Cardiology, 2004, vol. 11(6), pp. 733-743.
Pak et al., "High-speed propulsion of flexible nanowire motors: Theory and experiments," Soft Matter 7.18, 2011, vol. 7, pp. 8169-8181.
Sawetzki et al., "In situ assembly of linked geometrically coupled microdevices," PNAS, 2008, vol. 105(51), pp. 20141-20145.
Tasci et al., "Surface-enabled propulsion and control of colloidal microwheels," Nature Communications, 2016, 6 pages.

(56) References Cited

OTHER PUBLICATIONS

Official Action for U.S. Appl. No. 13/770,875, dated Apr. 20, 2015, 10 pages.
Official Action for U.S. Appl. No. 13/770,875, dated Oct. 28, 2015, 10 pages.
Official Action for U.S. Appl. No. 13/770,875, dated Feb. 9, 2016, 11 pages.
Notice of Allowance for U.S. Appl. No. 13/770,875, dated Jul. 7, 2016, 12 pages.
Official Action for U.S. Appl. No. 14/307,269, dated Dec. 15, 2015, 10 pages.
Final Action for U.S. Appl. No. 14/307,269, dated Aug. 8, 2016, 10 pages.
Advisory Action for U.S. Appl. No. 14/307,269, dated Dec. 7, 2016, 3 pages.
Official Action for U.S. Appl. No. 14/307,269, dated Mar. 1, 2017, 10 pages.
Notice of Allowance for U.S. Appl. No. 14/307,269 dated Sep. 6, 2017, 7 pages.

* cited by examiner

FIBER-FOCUSED DIODE-BAR OPTICAL TRAPPING FOR MICROFLUIDIC MANIPULATION

CROSS-REFERENCE TO RELATED APPLICATIONS

This Application claims the benefit of U.S. Provisional Application No. 60/975,429, filed Sep. 26, 2007, the entire disclosure of which is hereby incorporated herein by reference.

FIELD OF THE INVENTION

The present invention is directed toward methods and devices for manipulating particles within flow using linear geometries.

BACKGROUND

A laser beam may be focused to a diffraction-limited spot with a high numerical-aperture objective allowing micron-sized objects in solution to be trapped in three dimensions into the region of highest light intensity. In 1970, Ashkin introduced and demonstrated the feasibility of this non-contact manipulation technique, dubbed optical or laser tweezers. Because the focused laser beam encounters an index of refraction mismatch between the particle and surrounding solution light is redirected, which induces a change in light momentum that must be balanced by the object. The net effect of this phenomenon is the immobilization of small micron-sized objects in the laser beam's focus. This tool has received broad interest because it allows non-contact, non-invasive and precise manipulation of objects in solution on the microscopic scale and has been applied in fields including chemistry, biology, colloidal, and polymer science. The utility of optical trapping in these various fields has led to interest in its implementation within microfluidic systems where, for example, direct cell manipulation would be a significant aid (e.g. lab-on-a-chip applications). However, the dynamic nature of such flowing systems, particularly those focused upon microscale separations, demand an optical trapping technique that can be spatially translated.

SUMMARY

Dynamic optical trapping techniques based on rapidly-scanned mirrors or holographic array generators are powerful and demonstrate the capabilities of optical-based manipulation, however, they require significant associated optical hardware which hinders implementation for biomedical research and medical point of care applications. To overcome this barrier, embodiments of the present invention employ various schemes that take advantage of the nature of microfluidic fluid dynamics and use relatively inexpensive diode laser bars for the manipulation of particles in microscale geometries. This approach allows control of objects within the dimensions of the emitter, typically a 1 mm by 100-200 mm line and is uniquely facilitated by the confining microchannel geometries in which optical trapping occurs. Traditionally, and in non-confining 3D systems, design of the optical trap requires high numerical aperture (NA) objectives and tightly-focused Gaussian beams. This design is driven by the need to create strong optical gradients in the axial-dimension to overcome gravity and optical scattering forces. With a pseudo-2D confining geometry that limits particle translation to a flowing microfluidic plane, optical intensity gradients in the lateral dimensions dominate particle motion thus greatly diminishing optical requirements. Taking full advantage of this, it can be demonstrated that the use of inexpensive cylindrical plastic fibers as the sole optical component required to focus laser radiation for optical trapping-based separations within microchannels.

Thus, a new and effective approach for integrating diode bar based optical trapping within microfluidic geometries using optical fiber is provided herein. Because of the elongated geometry of the emitter, such cylindrical physical systems provide an inexpensive and easily integrated optical focusing tool. To demonstrate its utility the effective trapping forces in flowing microfluidic systems have been measured and compared to model-based predictions. The results demonstrate that line-based optical trapping within confining environments has a number of advantages including significantly reduced local intensities for equivalent trapping forces, preventing damage to cells when this is a design factor. In addition, the optical pressure arising from the low-NA optics employed here produces a push toward the channel wall that can be used advantageously by moving cells to streamlines of lower velocity, lowering drag and the required optical trapping intensities.

In accordance with at least some embodiments of the present invention, a method is provided that generally comprises:

- providing a diode emitter;
- creating a diode laser bar with the diode emitter, wherein the diode laser bar comprises a predetermined wavelength;
- focusing the diode laser bar through a fiber optic element;
- directing the focused diode laser bar at a microfluidic flow; and
- trapping at least one particle in the microfluidic flow with the focused diode laser bar.

In accordance with at least some embodiments of the present invention, an apparatus is also provided that generally comprises:

- an emitter operable to produce a laser beam having a predetermined wavelength;
- a channel comprising a microfluidic flow of a first fluid; and
- a fiber optic element positioned to operably focus the laser beam produced by the emitter on at least a portion of the microfluidic flow through the channel to trap particles in the first fluid.

In accordance with at least some embodiments of the present invention, an apparatus is also provided that generally comprises:

- a diode emitter operable to create a diode laser bar having a predetermined wavelength that is higher than the wavelength of visible light; and
- a fiber optic element operable to focus the diode laser bar created by the diode emitter and direct the focused diode laser bar on at least one particle flowing within a microfluidic flow such that the at least one particle can be trapped with optical forces within the microfluidic flow and manipulated with the optical forces, wherein the fiber optic element comprises a diameter between about 0.5 mm and 1.5 mm, wherein the fiber optic element is comprised at least in part of a polymethyl methacrylate material, and wherein the fiber optic element is oriented substantially perpendicular with respect to the channel and the direction of the microfluidic flow.

These and other advantages will be apparent from the disclosure of the invention(s) contained herein. The above-described embodiments and configurations are neither complete nor exhaustive. As will be appreciated, other embodiments of the invention are possible using, alone or in combination, one or more of the features set forth above or described in detail below.

DETAILED DESCRIPTION

Figure 1:
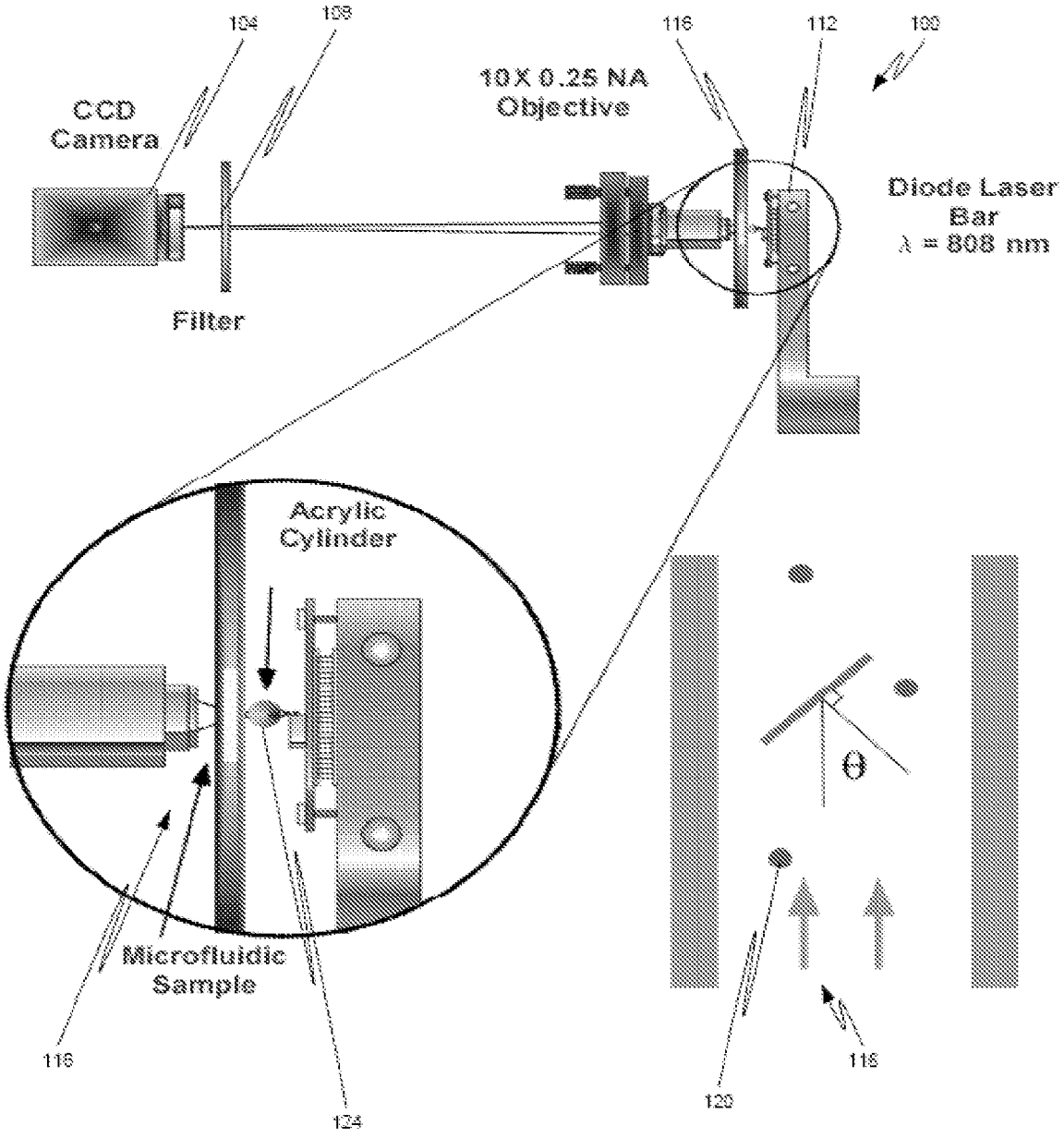
FIG. 1 depicts a series of graphs of high-throughput flow-based optical mechanical testing where dual line optical traps stretch hydrodynamically-focused cells in accordance with at least some embodiments of the present invention.

Referring initially to FIG. 1, an exemplary particle manipulation system 100 will be described in accordance with at least some embodiments of the present invention. Diode laser bar trapping studies employed an emitter 112, 200 μm by 1 μm (as produced by Snoc Electronics under LD-005), capable of producing 2W of average power and centered at a wavelength of 808nm with an integrated cylindrical micro-lens. The emitter 112 output was imaged directly into the microfluidic sample 116 through a 1 mm diameter PMMA (polymethyl methacrylate, n=1.49) (as produced by Industrial Fiber Optics) fiber 124 placed perpendicular to the beam pathas can be seen in FIG. 2. More specifically, FIG. 1 depicts high-throughput flow-based optical mechanical testing where dual line optical traps stretch hydrodynamically-focused cells. This small section of fiber 124 allows for focusing in the bar fast axis, the axis used to trap particles 120 in our flowing microfluidic systems 116. The fiber 124 can have a diameter that is greater than 0.5 mm and that is no greater than 1.5 mm. The microfluidic sample 116 generally comprises a multiple angle, single channel geometry with only one input and one output, and channel walls enclosing the microfluidic flow. The microfluidic flow 116 and particles120 contained therein may be viewed through a 10×, 0.25NA objective with a CCD camera 104 which views the microfluidic sample 116 through an optical filter 108. Excluding sample imaging, the entire optical train can be approximately 1 cm long.

The trapping force was estimated experimentally by gradually increasing microfluidic flow rate at constant laser power (~750 mW in the sample plane) until the particles within the flow passed through the laser trap at near zero velocity despite the applied optical force. At this point the trapping force is approximately balanced with the drag force of the flowing fluid estimated using a CCD camera and particle distances measured between frames taken every 1/30th of a second. Different trap angles (0°, 20°, 30°, 45°, 60°) relative to flow were used in our measurements with the component of the resulting force vector in the direction normal to the line trap averaged to obtain the experimental value for a given particle size.

To determine net restoring forces with varying illumination geometries, a modeling approach can be used that allows calculation of local stress, which can be integrated to obtain desired values. This approach may be based on the modeling of cell "stretching" forces where the classic Mie ray optics approach is extended to calculation of local stress profiles across the front and back sphere surfaces. In calculations, the laser light source may be treated as an infinite number of rays coming in parallel to the vertical axis with the field modeled using a Gaussian with a spot of tunable size and focus position:

$$E(x, y, z) = \frac{\omega_0}{\omega(z)} e^{-\frac{((x-x_0)^2+y^2)}{\omega(z)^2}} e^{-i\left[k\left(z+\frac{(x-x_0)^2+y^2}{2R_c(z)}\right)-\zeta(z)\right]}$$

$$\omega(z) = \omega_0\sqrt{1+\left(\frac{z}{z_0}\right)^2}$$

where $\omega_0$ is the minimum spot size, k is the wavenumber, Rc is the radius of curvature of the Gaussian beam, and ζ is the Guoy phase term. The reflectance and transmittance ($T=1-R_R$) may be taken into account due to the cell front and back interfaces, using the polarization-dependent Fresnel equations:

$$R_{R\perp} = \left(\frac{n_m\cos\phi_0 - n_p\cos\beta}{n_m\cos\phi_0 + n_p\cos\beta}\right)^2 R_{RP} = \left(\frac{n_m\cos\beta - n_p\cos\phi_0}{n_m\cos\beta + n_p\cos\phi_0}\right)^2;$$

$$R_R = \frac{R_{R\perp} + R_{RP}}{2}$$

where $\varphi_0$ and β are the front and back ray angles relative to the normal and the n are the refractive indices. In this model, the net force at each position on the cell surface is the change in momentum of the incident ray minus those of the transmitted and reflected rays. To simplify calculations multiple reflections may be neglected and have verified results quantitatively by integration of the calculated local stress over the top and bottom surfaces, obtaining the net trapping force and comparing these to results available in the literature.

Experiments demonstrate that optical fiber can be used as an inexpensive means of focusing line-trap illumination within microfludic systems. Qualitatively, smaller fiber provides a tighter focus and more efficient optical trapping but is more difficult to couple to the emitter leading to greater losses. In accordance with at least some embodiments of the present invention, the fiber optic element comprises a diameter between about 0.5 mm and 1.5 mm. In accordance with a more specific embodiment of the present invention, a 1 mm diameter fiber provides a balance between NA (providing a value of ~0.55 in air) and light collection with minimal losses. As illustrated in FIG. 1, a fiber external 124 to the microfluidic sample 116 may be employed; however, due to the low cost, fiber focusing could be readily incorporated directly into the disposable PDMS (i.e., microfluidic sample) matrix at approximately one-third the NA with these specific materials.

In traditional implementation of the optical trapping technique, high-index particles are driven to the center of the trap focus where the net force is zero. In the flowing systems used here with the additional drag forces present, pseudo-equilibrium will occur at positions offset from the trap and particle center. FIG. 1 depicts a system arrangement for fiber-focused microfluidic trapping integration. Inset includes illustration of diode bar optical trap within microfluidic flow channel.

Figure 2:
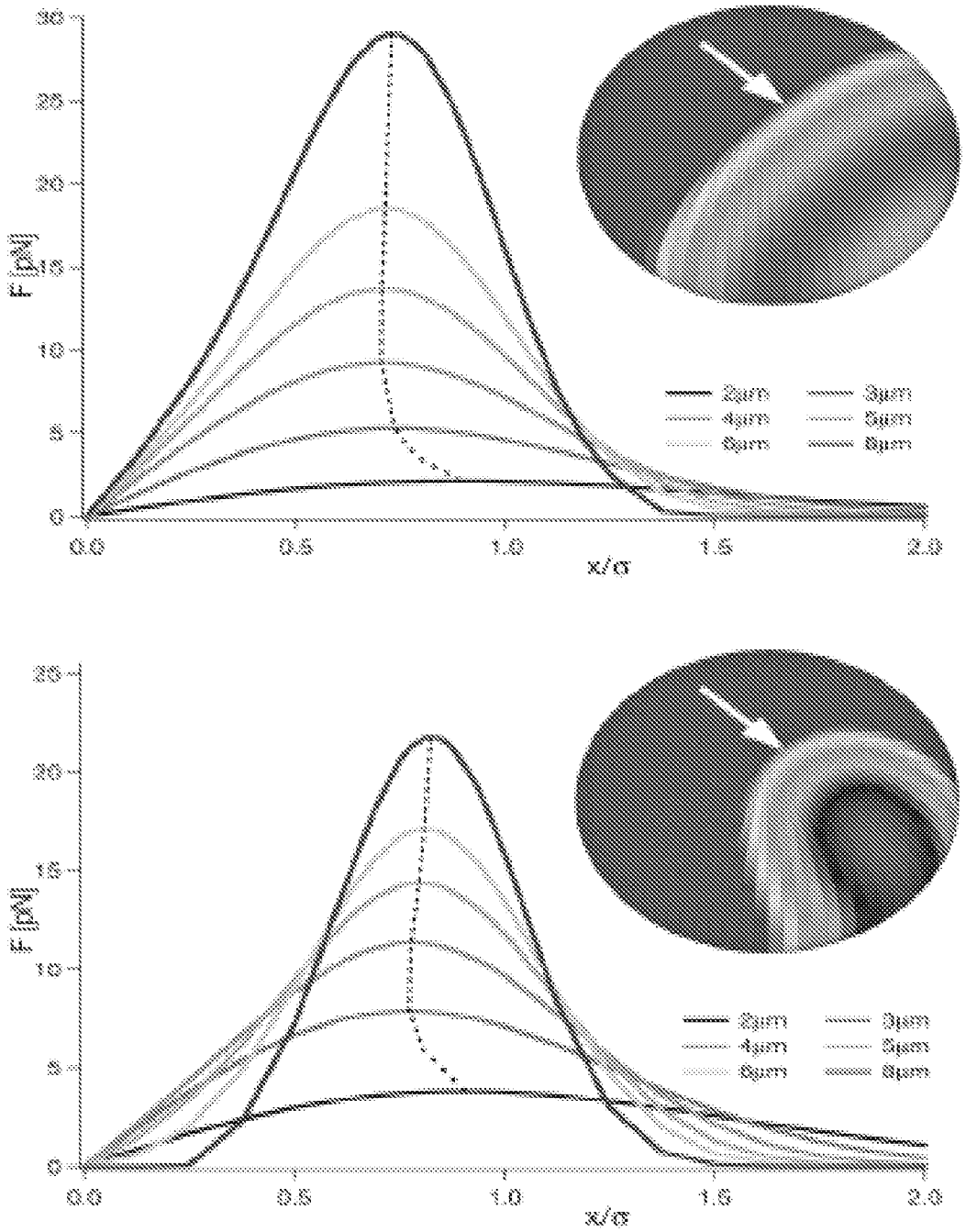
FIG. 2 depicts a system arrangement for fiber-focused microfluidic trapping integration in accordance with at least some embodiments of the present invention.

FIG. 2 represents net calculated restoring force predictions as either bar (750 mW/200 μm) or spot (30 mW/3 μm) illumination is translated away from the particle center. Here, and as expected, a maximum is observed as the trap is moved away from the center where net forces balance, to the particle edge where illumination intensity diminishes. It is this predicted maximum that we take as the effective trapping force in flow. One very useful observation from this calculation is that one obtains an equivalent trapping force by moving to a line-source with local intensity no more than half that of the local intensity in the spot case. Such reduced local intensities available from non point-source optical traps could prove significant in preventing damage to cells in systems where strong optical forces are required.

Figure 3:
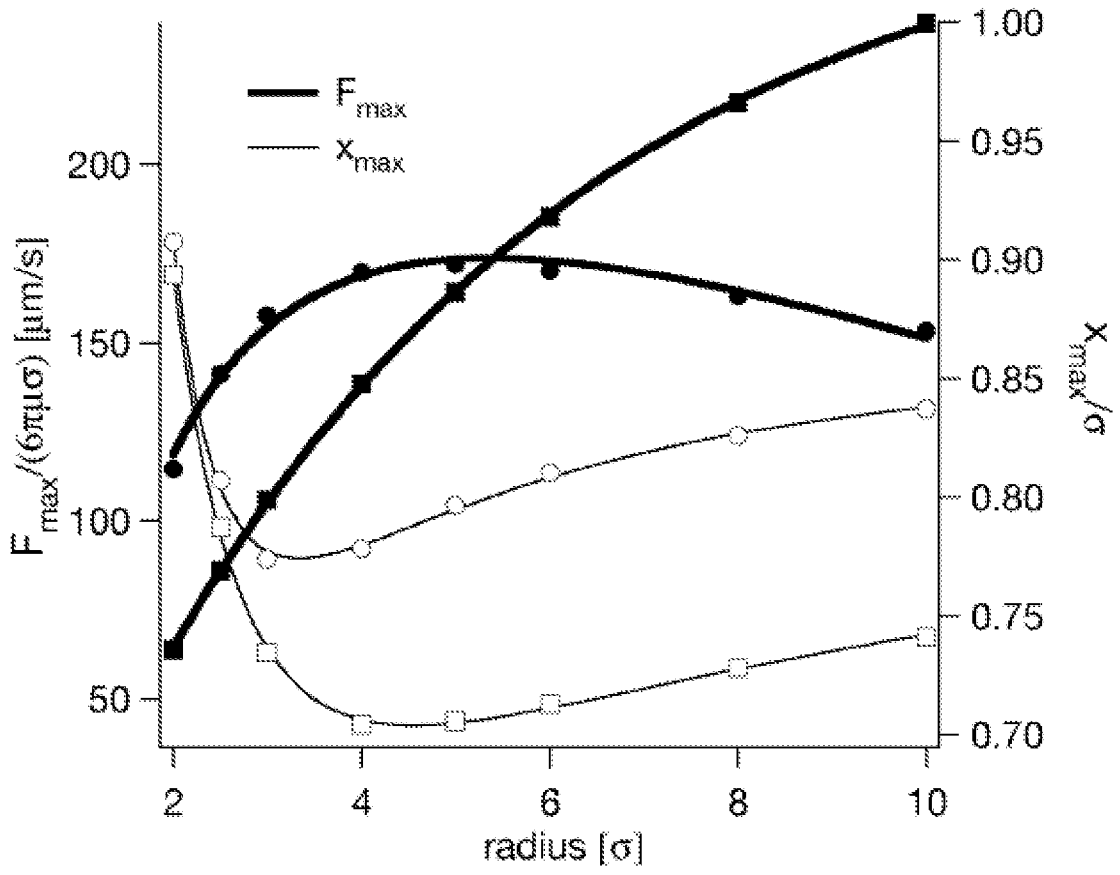
FIG. 3 is a graph depicting normalized restoring force and position of force maximum for bar and spot illumination in accordance with at least some embodiments of the present invention.

FIG. 3 highlights the position and relative strength of the extracted restoring force maximum as a function of particle size. FIG. 3 depicts normalized restoring force and position of force maximum for bar (■□) and spot (●○) illumination. Note here the balance between the restoring force and the drag force as one moves towards larger particle sizes. In the case of spot illumination, drag begins to dominate for the larger particle sizes whereas bar-based sources continue to be controlled by trapping forces even as the size increases.

Figure 4:
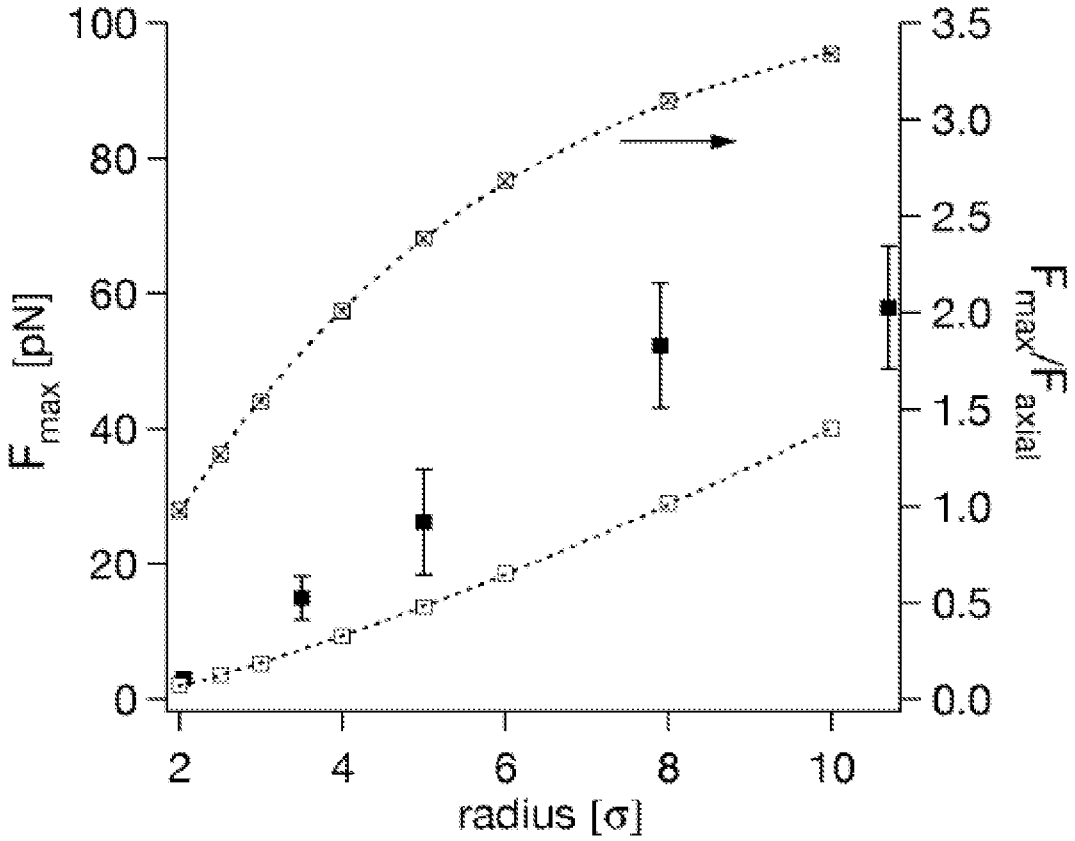
FIG. 4 is a graph depicting a comparison to experimental estimates from microfluidic diode-bar flow measurements in accordance with at least some embodiments of the present invention.

Though one goal of the present invention is to demonstrate the utility of fiber-based diode-bar focusing, current modeling approaches allow quantitative prediction of trapping force for a given particle size and diode laser intensity. When comparing our predictions and those values determined experimentally a number of corrections and assumptions must be made. Experimental measurements consist of particle velocity from which an estimated maximum restoring force is extracted using values for the Stokes drag on a sphere. It is well known however that the Stokes drag is modified in the presence of confining plates. In addition, as quantified in the calculations of FIG. 4, there are optical forces pushing the particles toward the wall where drag is further enhanced. FIG. 4 more specifically depicts a comparison to experimental estimates from microfluidic diode-bar flow measurements. Predictions of restoring vs. wall forces (□) with varying particle size. Following Miwa, et al., and assuming the colloids are translated next to the surface we apply corrections for both wall confinement and proximity. To obtain an estimate of the trapping force in the direction of flow however, the local fluid velocity at the particle position is also required. Here we assume a parabolic profile between confining surfaces with maximum velocity given by the particle velocity upon entering the trap. Finally, it should be noted that the intensity profile along the beam length is not constant as the beam diverges within the trapping plane due to the fiber-based focusing and the square profile from the emitter evolves towards a sinc profile within the trapping plane. Our experimental measurements were therefore performed near the bar center and a correction of ~30% used for comparison to our modeling predictions based on average bar intensity. Despite the approximate nature of this approach, comparison between these experimental estimates and theory show similar trends and reasonable quantitative agreement. Also shown in FIG. 4 is the relative strength of the restoring force to the axial force for the 3 mm wide bar as one progresses from smaller to larger particles. Though calculations are based on our specific low-NA optics, it can be seen that axial forces become significantly less important relative to trapping forces as particle size is increased.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An optical trapping device, comprising:

a diode laser bar emitter;

a microfluidic channel comprising a microfluidic flow with particles therein; and a fiber optic element having a diameter of 1 mm, positioned between the diode laser bar emitter and the microfluidic flow to receive a laser beam emitted from the diode laser bar emitter and to focus the laser beam on at least one particle flowing within the microfluidic flow.

2. The device of claim 1, wherein the diode laser bar emitter emits a laser beam comprising a wavelength of about 808 nm.

3. The device of claim 1, wherein the fiber optic element is comprised at least in part of a polymethyl methacrylate material.

4. The device of claim 1, wherein the fiber optic element is oriented substantially perpendicular with respect to the microfluidic channel and the direction of the microfluidic flow.

5. The device of claim 1, wherein the diode laser bar emitter emits a laser beam comprising a square profile.

6. The device of claim 1, wherein the diode laser bar emitter emits a laser beam of a wavelength that is longer than the wavelength of visible light.

7. The device of claim 1, wherein the fiber optic element is external to the microfluidic channel.

8. The device of claim 1, wherein the fiber optic element is incorporated into the microfluidic device.

9. The device of claim 1, further comprising:

a trap angled relative to the microfluidic flow.

10. The device of claim 9, wherein the trap angled relative to the microfluidic flow exhibits an angle of 0°, 20°, 30°, 45°, or 60°.

* * * * *